US008347570B1

(12) United States Patent
Shupe et al.

(10) Patent No.: US 8,347,570 B1
(45) Date of Patent: Jan. 8, 2013

(54) CROWN MOLDING FASTENER

(76) Inventors: Jim Shupe, Graysville, TN (US); David Shupp, Lake Wales, FL (US)

( * ) Notice: Subject to any disclaimer, the term of this patent is extended or adjusted under 35 U.S.C. 154(b) by 264 days.

(21) Appl. No.: 12/702,413

(22) Filed: Feb. 9, 2010

Related U.S. Application Data

(60) Provisional application No. 61/244,976, filed on Sep. 23, 2009.

(51) Int. Cl.
*B44F 7/00* (2006.01)
*E04F 19/04* (2006.01)
*E04F 19/06* (2006.01)

(52) U.S. Cl. ..... 52/288.1; 52/287.1; 52/311.1; 52/312; 52/311.3; 52/716.1; 52/718.01; 52/718.04; 52/717.04

(58) Field of Classification Search ..... 52/288.1, 52/287.1, 717.06, 717.04, 717.05, 718.04, 52/718.03, 718.06, 717.03, 698, 712–715, 52/311.1–311.3, 312–316, 716.1, 716.8, 52/717.01, 718.01, 718.05, 718.07, 718.02; 24/289–297
See application file for complete search history.

(56) References Cited

U.S. PATENT DOCUMENTS

| | | | | |
|---|---|---|---|---|
| 1,539,219 | A * | 5/1925 | Taseff | 52/706 |
| 2,531,348 | A * | 11/1950 | Amesbury | 24/290 |
| 2,677,862 | A * | 5/1954 | Flora | 24/290 |
| 2,716,263 | A * | 8/1955 | Flora et al. | 24/291 |
| 2,852,828 | A * | 9/1958 | Hamman | 24/291 |
| 2,961,723 | A * | 11/1960 | Hamman | 24/289 |
| 5,035,099 | A * | 7/1991 | Lapish | 52/713 |
| 5,456,052 | A * | 10/1995 | Anderson et al. | 52/713 |
| 6,911,597 | B2 * | 6/2005 | Seamans et al. | 174/507 |
| 2009/0151134 | A1 * | 6/2009 | Neuhofer, Jr. | 24/292 |
| 2010/0059642 | A1 * | 3/2010 | McLeod | 248/207 |

* cited by examiner

*Primary Examiner* — Jeanette E. Chapman
(74) *Attorney, Agent, or Firm* — Stephen J Stark; Miller & Martin PLLC

(57) ABSTRACT

A crown molding fastener has a connector portion connected to a mount portion. The mount portion has a tail connected to a foot. The foot is connected such as by adhering and/or anchoring to a rear side of crown molding. The connector portion has a base connected to at least one of a wall and a ceiling. The connector portion connects to a clamp. The clamp receives the tail there through and upon pulling the tail a desired amount, a tension is applied between the foot and the clamp such as by providing a resilient tail and/or a spring member between the base and the clamp.

6 Claims, 2 Drawing Sheets

CROWN MOLDING FASTENER

CLAIM OF PRIORITY

This application claims the benefit of U.S. Provisional Patent Application No. 61/244,976 filed Sep. 23, 2009.

FIELD OF THE INVENTION

The present invention relates to a fastening system for connecting crown molding to a structure, preferably with an upper portion of the crown molding contacting the ceiling and a bottom portion of the crown molding contacting a wall surface, and more preferably, to a crown molding fastener which does not necessarily require penetration through the crown molding with nails from outside of the molding through the crown molding from an exterior surface which would then require touch up work.

BACKGROUND OF THE INVENTION

When hanging crown molding, installers typically place crown molding in a desired location and then nail through portions of the crown molding into a wall behind the crown molding. While nail guns considerably simplify the process of connecting the crown molding to the wall, after driving nails through the crown molding, someone must then go back and caulk or otherwise fill in the nail hole prior to painting to keep from seeing the nail holes.

In some trim applications, efforts have been made to provide clips to assist in securing moldings such as shown in U.S. Pat. No. 2,521,354. While this design apparently works for its intended purpose, this design cannot easily be configured for some applications, such as for use in connecting crown molding to ceiling and wall in an easy fashion.

Accordingly, improvements over the prior art are believed to be needed.

SUMMARY OF THE INVENTION

It is an object of the present invention to provide crown molding fasteners which are capable of retaining a piece of crown molding at a desired location against the ceiling and a wall.

It is an object of at least some embodiments of the present invention to provide a crown molding fastener which may incorporate a resilient member thereby continuously providing a tension on the crown molding against the ceiling and/or wall.

It is another object of at least some embodiments of the present invention to provide a crown molding fastener which allows for at least some lateral movement of the crown molding piece once installed.

It is another object of at least some embodiments of the present invention to provide a crown molding fastener which can be selectively and/or incrementally positioned prior to tightening at a desired location.

It is yet another object of at least some embodiments of the present invention to be able to position the crown molding and then install the crown molding using a tensioning device.

Accordingly, in accordance with a presently preferred embodiment of the present invention, fasteners are shown in the figures installed to a piece of crown molding which is shown in phantom. As shown, multiple fasteners may connect to one or more pieces of crown molding in an installed configuration.

The presently preferred embodiment of the present invention includes a connector portion such as a base which preferably connects to a wall. Connected to the base is a spring member which assists in pulling the crown molding towards the ceiling and the wall. Connected to the spring member is preferably a self-activating clamp and/or a one way adjustment clamp which allows for a tension member to be pulled through the device for tightening and which will not release under normal situations. In addition to the connector portion a mount portion preferably connects a tail to a back side of the crown molding. One way of connecting the tail is to provide a foot which may have double sided tape connected thereto. A retainer may or may not be utilized with the tail passing through. Connectors such as screws, staples, etc. may pass through the retainer and/or foot to assist in retaining the tail to the crown molding. Other embodiments may connect to mount portion to a wall and the connector portion to the crown molding.

The tail may be in the form of a pull member such as zip-tie style tags or an elastic band, or other tail which passes through the clamp member. The free end of the tail is initially below a portion of the crown molding which contacts the wall. After an appropriate amount of pulling is performed, the free end of the tail can possibly be cut at a location below the crown molding and/or pushed up behind the crown molding such as with a putty knife or otherwise with the crown molding secured to the ceiling and wall.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
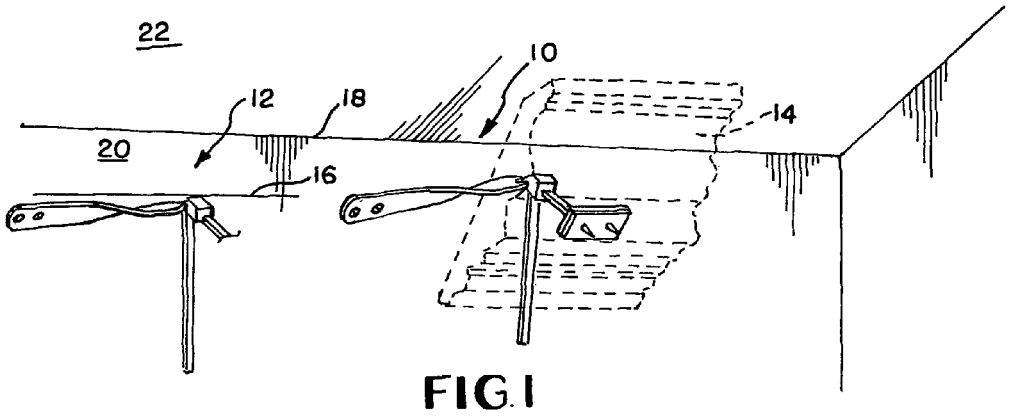
FIG. 1 is a bottom perspective cut away view of the presently preferred embodiment of a crown molding fastener of the present invention shown connected to a piece of crown molding shown in phantom with a portion of a second fastener shown as well.

FIG. 1 shows a first crown molding fastener 10 and a portion of a second fastener 12 as would be understood by those of ordinary skill in the art. One or more portions of crown molding 14 (shown in phantom) can be supported by fasteners 10,12 etc. The preferred fasteners 10,12 can be spaced over a width of the twenty inches or otherwise. It may be possible that some portions of crown molding 14 may be supported by a single fastener 10 and others by two and others by two fasteners 10,12 or significantly more, particularly for longer pieces of crown molding 14.

As can be seen in FIG. 1, the fasteners 10,12 are provided in a substantially linear arrangement, not necessarily perfectly linearly as may be understood with reference to positioning relative to linear segment 16 which is shown parallel to the corner line 18 where the wall 20 meets the ceiling 22. One of the advantages of a presently preferred embodiment of the present invention is that exact alignment of the fasteners 10,12 etc. is not required for proper installation of the crown molding 14 against the ceiling 22 and against the wall 20. Another advantage of a presently preferred embodiment is that connector portions 13 of fastener 10 need not necessarily be precisely aligned with mount portion 15.

Figure 2:
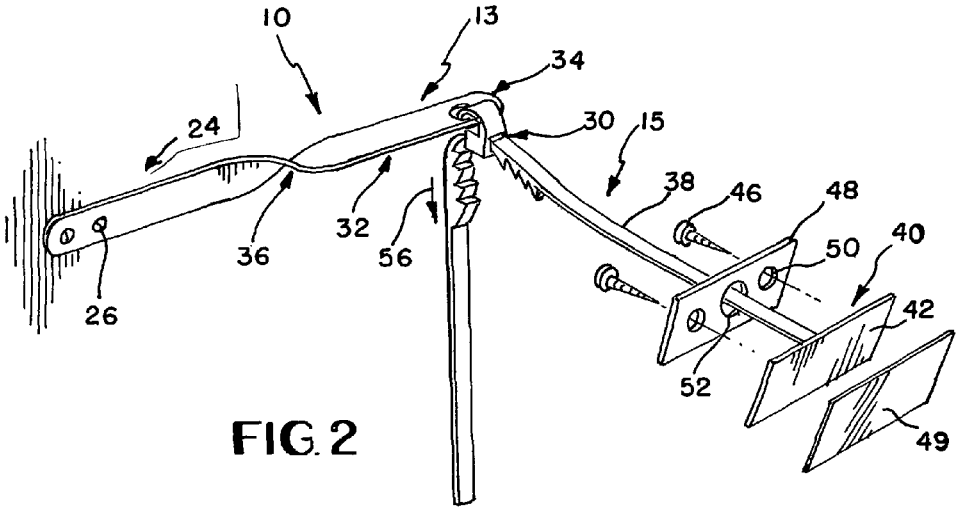
FIG. 2 shows a top perspective and partially exploded view of the crown molding fastener connected to a wall removed from the crown molding.
Figure 3:
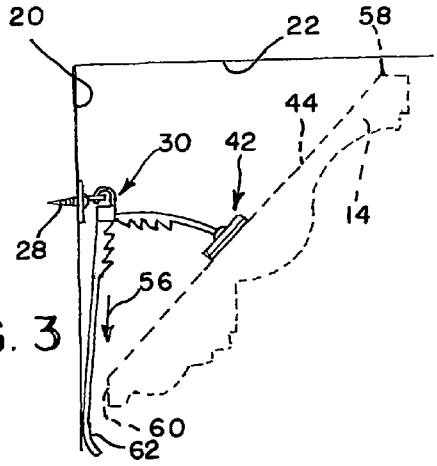
FIG. 3 shows a side view prior to providing tension on the tension member.

FIG. 2 is useful to show the separate components of the fastener 10. Connector portion 13 has a base 24 which may preferably be connected to a wall 20 or ceiling 22 with one or more connectors 26. Connectors 26 may be dry wall screws 28 as shown in FIG. 3 or other appropriate connectors, adhesives or other connection mechanism as would be understood by those of ordinary skill in the art. The base 24 is illustrated connected to wall 20 at a desired location preferably positioning is selected to locate the clamp 30 at a desired position as will be explained in further detail below.

Connected to the base 24 is preferably a spring member 32 which may be integrally or otherwise provided and/or connected relatively to base 24. Base 24 could be metal, plastic or other appropriate material. Spring member 32 could be metal, plastic or other appropriate materials and could be similar or dissimilar materials relative to that of base 24. Connected to the spring member 32 is the clamp 30. In the illustrated embodiment, clamp 30 is disposed towards a distal end 34 of the spring member 32 but is not necessarily required to be positioned at that location for all embodiments. Opposite the distal end 34 of spring member 32 is a proximal end or portion 36 which may connect to the base 24 such as is illustrated or otherwise.

Tail 38 which may be plastic or other material. In the illustrated embodiment tail 38 has a somewhat similar configuration to a zip tie. In fact, a portion of a zip tie could form a portion of tail 38 in variations of the embodiments.

Figure 4:
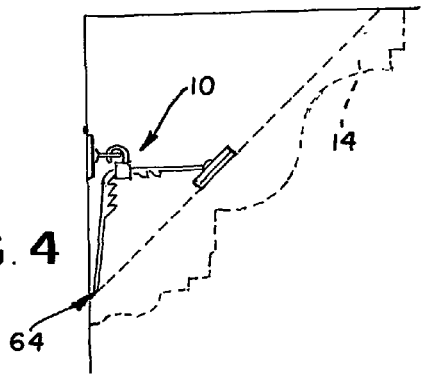
FIG. 4 shown an installed configuration with the tension member appropriately displaced behind the crown molding and/or cut off above the crown molding piece.

The tail 38 preferably has an end 40 which is a terminus which could be plastic, metal and/or other material and connects and/or terminates at a foot 42. The foot 42 may be securely connected to the back 44 of crown molding 14 which is shown in FIGS. 3 and 4 and would be understood from FIG. 1. Foot 42 may take various shapes and can preferably be connected to molding 14 such as by screws 46 illustrated in FIGS. 1 and 2, staples other connector(s) and/or one or more adhesives such as double sided tape 49 or other adhesive. 3M's 4116 urethane foam tape has been found to function particularly well. This tape has a lengthy tack time but once it cures, it adheres stronger and stronger with the passage of time. Mechanical fasteners may be utilized to connect the foot 42 to the back 44 of the crown molding 14 possibly with or without adhesives.

While the mount portion 15 is shown connected to the crown molding 14 and the connector portion 13 to a wall 20 (or ceiling 22), the connector portion 13 could be connected to the crown molding 14 and the mount portion 15 to the ceiling 22 and/or wall as would be understood by those of ordinary skill in the art.

The foot 42 is preferably securely connected to the back 44 of the crown molding 14. Retainer 48 may be useful to provide a desired support for supporting screws 46 as they penetrate through bores 50 and/or through foot 42 and adhesive 49 if utilized. Furthermore, it would also be possible to staple or provide other connectors through such a construction or other connector. Passage 52 may be utilized to assist in allowing the tail 38 to pass through the retainer 48. Tail 38 has a free end 62 which may be connected to the tail 38 which could be similar or dissimilar to other portions of tail 38, free end 62 could be a portion of a pull cord, ribbon, strap such as an elastic strap, tie as an extension mechanism, extender or other tension applicator.

The tail 38 may pass through head or clamp 30 which could be a zip tie strap head or other clamp through which tail 38 passes therethrough. Clamp 30 could be a ratchet style adjustment member, tie wrap adjustment member, one way locking member or other mechanism.

The clamp 30 preferably connects to the at least one of the wall 20 and/or ceiling 22 in the various embodiments. The illustrated embodiment connects to the wall 20 as described above or otherwise. The clamp 30 illustrated in FIG. 2 is common to a zip tie head which receives a portion of the zip tie therethrough which allows for the movement of a zip tie in the direction 56 illustrated while preventing movement in an opposite direction as would be understood by those of ordinary skill in the art. This is an incrementally adjusting, anti-reversing, one way, self-locking and/or clamp 30 in the illustrated embodiment. Operation of clamp 30 will be described in further detail below. Other clamps 30 could be utilized in other embodiments.

As the tail 38 is pulled through the clamp 30, the molding 14 preferably becomes tight with ceiling surface 58 contacting ceiling 22 and wall surface 60 contacting wall 20 and/or connector or tail 38 such as a connector portion as illustrated in FIG. 3. As can be seen in operation in FIGS. 3 and 4, the tail 38 is in tension when directed in the direction 56 illustrated, thereby pulling the base 42 towards the clamp 30 until the surfaces 58,60 contact the ceiling 22 and wall 20 respectively. With additional pulling, the spring member 32 deflects such as resiliently or continues to deflect so that a tight fit of molding 14 can be provided.

The resilient member illustrated as spring member 32 continues to hold a tight configuration after releasing free end 62 of tail 38. The one way clamp 30 locks the connector 38 with a desired and/or predetermined amount of tension between the clamp 30 and the foot 42 to maintain the desired position of the molding 14. The connector, or tail 38, below the wall surface 60 can then be cut and/or pushed up above the top 64 of the wall surface 60 of the crown molding 14 so that the wall surface 60 sits flush against the wall 20 as is illustrated in FIG. 4.

Once installed because the spring member 32 is resiliently biased, the molding 14 can preferably be moved laterally (i.e., as is the direction parallel to the linear segment 16) at least somewhat (such as ¼, ½ an inch or so). Furthermore, during installation, the base 24 and tail 38 need not exactly align with the clamp 30 but may be laterally displaced relative to the connector 30 at least in some degree. This prevents a need for an extreme precise alignment of the connector portion 13 to the mount portion 15 while still providing a desired function of the fastener 10.

Figure 5:
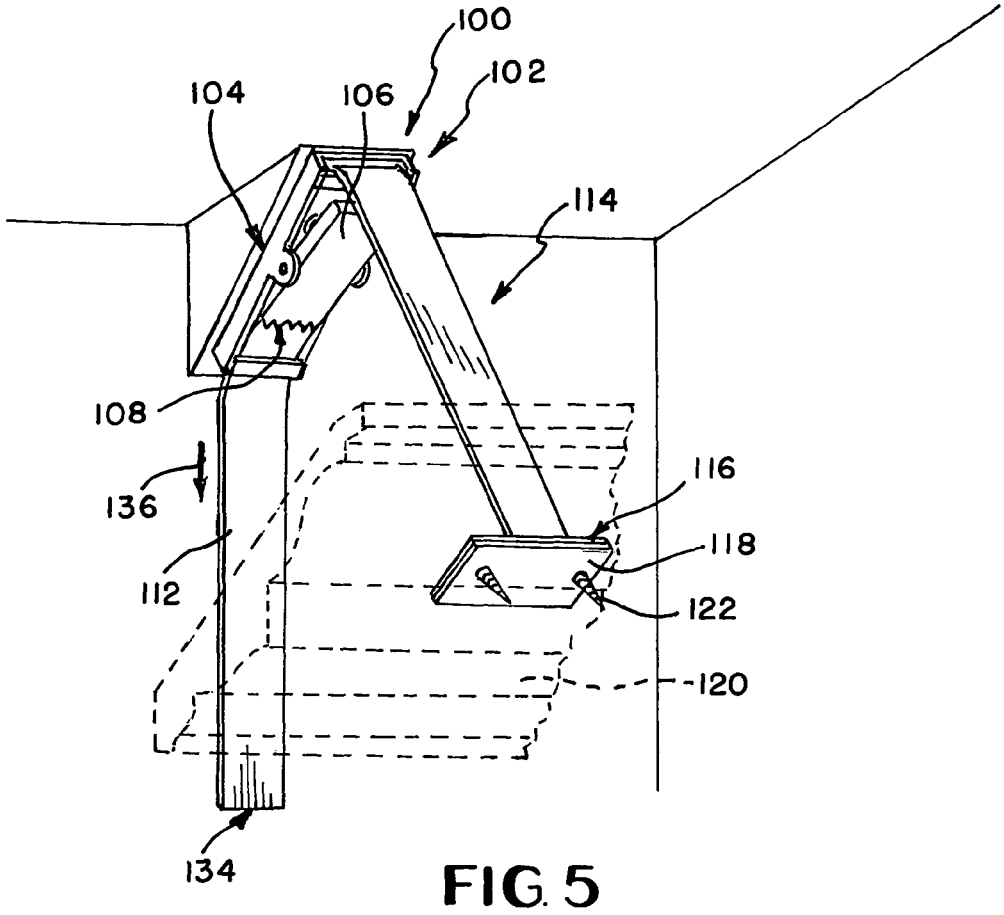
FIG. 5 is a first alternative embodiment of the present invention.
Figure 6:
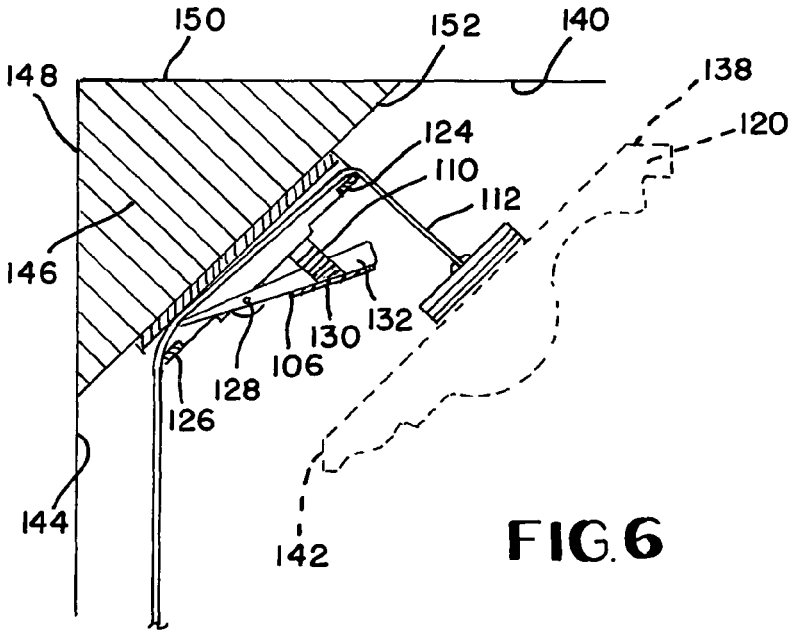
FIG. 6 is a cutaway view of a connector portion of the alternatively preferred fasteners shown connected to the alternatively preferred tail.

FIGS. 5 and 6 show an alternatively preferred embodiment of the present invention. Connector portion 102 of fastener 100 has a clamp 104 such as a panel member 106 with teeth 108 which is resiliently biased such as with spring member 110 so that teeth 108 may dig into tail 112. Tail 112 preferably includes a resilient member such as an elastic band and is shown as a portion of mount portion 114 connecting to base 116 which is shown with double sided tape or other adhesive 118 for connection to crown molding 120. Screws or other connectors 122 can assist in connecting base 116 to crown molding 120. Guides 124,126 are useful in directing the tail 112 through the panel member 106. Panel member 106 may rotate about pivot 128 as can be illustrated in FIG. 6. Spring member 110 may push against platform 130 which is useful to bias the panel member 106 at a desired tension. Of course, prior to finishing the installation process, pressing on release 132 can release the teeth 108 from the tail 112 to allow for readjustment.

This embodiment also has the ability to provide one way locking such as by allowing the pulling on the tail 112 by free end 134 to the desired configuration. It would be understood that the teeth 108 would not dig in but would allow the clamp 106 to rotate about pivot 128 during that movement in the direction illustrated by arrow 136. However, upon releasing tension, the teeth 108 would retain the tail 112 in a desired position while the tail 112 would provide a resiliently tight tension through the base 116 to the crown molding 120 to retain the upper surface 138 against ceiling 140 and the wall surface 142 against the wall 144.

The clamp 104 may be connected to at least one of the wall 144 and/or ceiling 140 such as with block 146 or other mechanism. Block 146 preferably has a wall side 148 and a ceiling side 150 such as providing a triangle cross section as shown in FIG. 6 or otherwise. The clamp 104 connects to face 152 thereby directing tail to tail 112 through guides 124,126. When the free end 134 of tail 112 is pulled, tension may be applied. The block 146 may be installed such as with connectors such as screws, nails or otherwise to at least one of the ceiling 140 and wall 144. The crown molding 120 may be put in position at a desired location with tension applied through the tail 112 to the base 116. Of course, other features may be similar to other embodiments and may have similar features of the alternatively preferred embodiment of fastener 100 and the embodiment of fasteners 10,12 as would be understood by those of ordinary skill in the art.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. The crown molding fastener for use in connecting crown molding having a ceiling face and a wall face to a ceiling and a wall, respectively, said fastener having:

a connector portion, said connector portion having a base and a clamp connected to the base;

a mount portion, said mount portion having a tail operably coupled to and extending from a foot;

wherein the foot is connected to the crown molding, and one of the wall and the ceiling is connected to the base and then upon directing the tail through the clamp and applying tension to a free end after passing through the clamp, and said tail at least assists in resiliently biasing the wall face against the wall and the ceiling face against the face between the clamp and the foot; wherein the tail has angled ramps terminating in flats thereby at least assisting in the clamp allowing for movement of the tail in one direction relative to the clamp while resisting movement in a direction reverse to the one direction.

2. The crown molding fastener of claim 1 wherein the clamp is a zip tie head.

3. The crown molding fastener for use in connecting crown molding having a ceiling face and a wall face to a ceiling and a wall, respectively, said fastener having:

a connector portion, said connector portion having a base and a clamp connected to the base;

a mount portion, said mount portion having a tail operably coupled to and extending from a foot;

wherein the foot is connected to the crown molding, and one of the wall and the ceiling is connected to the base and then upon directing the tail through the clamp and applying tension to a free end after passing through the clamp, and said tail at least assists in resiliently biasing the wall face against the wall and the ceiling face against the face between the clamp and the foot; wherein the foot is connected to the crown molding with at least one of a connector and an adhesive.

4. The crown molding fastener of claim 3 wherein the adhesive is a portion of double sided tape connecting the foot to the back of the crown molding.

5. The crown molding fastener of claim 3 wherein the connector is selected from the group of screws and staples.

6. The crown molding fastener of claim 3 further comprising a retainer extending over a portion of the foot, said retainer assisting in connecting the base to the back of the crown molding.

* * * * *